United States Patent [19]

Denisart et al.

[11] 3,988,037

[45] Oct. 26, 1976

[54] METHOD OF BREAKING A HARD COMPACT MATERIAL, MEANS FOR CARRYING OUT THE METHOD AND APPLICATION OF THE METHOD

[75] Inventors: Jean-Paul Denisart, Lutry; Barry E. Edney; Bo Lemcke, both of Lausanne, all of Switzerland

[73] Assignee: Institut Cerac SA, Vaud, Switzerland

[22] Filed: Apr. 17, 1975

[21] Appl. No.: 569,286

[30] Foreign Application Priority Data

Apr. 25, 1974 Switzerland ..... 5674/74

[52] U.S. Cl. ..... 299/16

[51] Int. Cl.[2] ..... E21C 37/00

[58] Field of Search ..... 299/13, 16, 17, 20; 102/22, 23, 25; 166/178

[56] References Cited

UNITED STATES PATENTS 99,595 2/1870 Robb ..... 299/16

479,500 7/1892 Githens ..... 299/13

*Primary Examiner*—Ernest R. Purser
*Assistant Examiner*—Richard E. Favreau
*Attorney, Agent, or Firm*—Flynn & Frishauf

[57] ABSTRACT

A hard compact material, such as rock, is broken by delivering a hydraulic fluid, such as water, into at least one hole which has been pre-drilled in the material to be broken, the hole functioning as an hydraulic fluid cylinder. A piston is driven into the hole to impact the fluid to generate a high pressure in the fluid and to cause tensile stress cracks in the material by the established pressure. Due to the concentration of the stress at the bottom of the hole, the cracks are initiated and spread generally radially outwardly substantially normal to the principal stress direction. A plurality of said holes may be drilled and the cracks linked together by appropriate choice of form, depth, orientation, spacing and number of the holes. Preferably, the piston is driven into the hole by means of a gun at speeds ranging up to several hundred meters per second.

40 Claims, 11 Drawing Figures

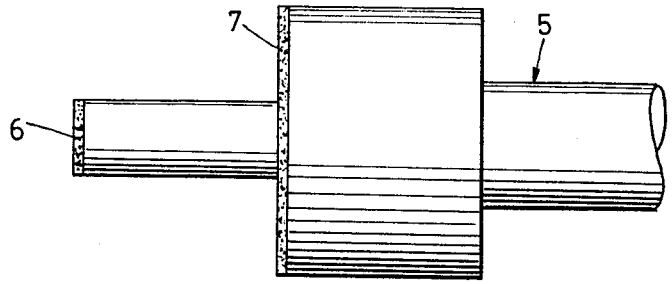
FIG. 9
FIG. 10
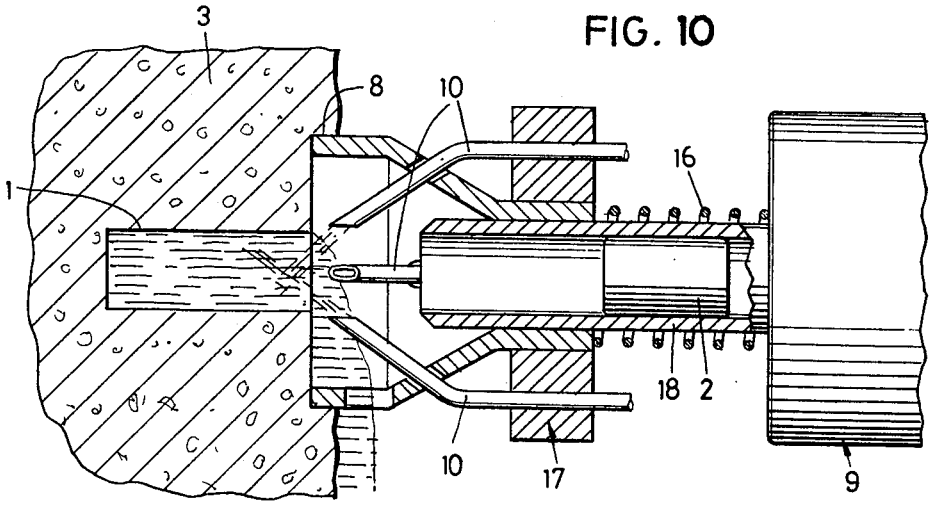
FIG. 11
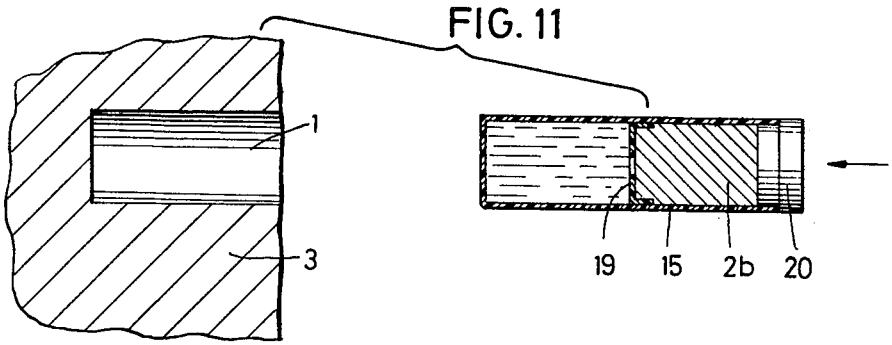

METHOD OF BREAKING A HARD COMPACT MATERIAL, MEANS FOR CARRYING OUT THE METHOD AND APPLICATION OF THE METHOD

This invention relates to a method and apparatus for breaking a hard compact material, especially rock, and more particularly to a method wherein at least one hole is pre-drilled in the material to be broken and the hole is filled with a liquid, whereafter the liquid is pressurized causing cracks to form in the material, and means for carrying out the method.

Conventional methods of rock breakage, including drilling-and-blasting, ripping and crushing (as in various full-face tunnelling machines) have several disadvantages.

The conventional drill-and-blast technique has the disadvantage of noise, gases, dust and flying debris, which means that both men and machines must be evacuated from the working face. Further disadvantages of the drill-and-blast technique are overbreak, which entails costly reinforcement of the tunnel wall in certain cases, and the obvious danger of storing and handling explosives in a confined working space.

Conventional crushing techniques are also inefficient in that the rock is made to fail in compression whereas it is weaker and would fail more easily in tension. Consequently, as a result of the large forces required to crush the rock, tool wear is significant, particularly in hard or abrasive rocks.

A hydraulic blasting technique used in mining coal has been equally known.

According to the German Pat. Spec. No. 241,966 a hole is drilled into the coal face to be broken, each hole being filled afterwards with water. The column of water in the hole is subjected to a sudden increase in pressure by a pressure transductor whereby the hole acts as a pressure water cylinder. When the pressure of water in the hole is suddenly increased from approximately 10 up to 20 atm to 200 atm, a pulse effect is created which corresponds to an explosive action caused by explosives. Due to this pulse of pressure the layer of coal to be broken out is disengaged in fragments.

The known hydraulic breaking technique described above can be applied with regard to the comparatively low pressure established in the water column only when breaking soft materials, e.g. coal; besides, by such a technique the size of the fragments is not controllable.

It is an object of the present invention to provide a method and means of breaking a hard compact material, especially rock such as granite etc., by using an hydraulic breaking technique by means of which the size of the fragments broken out of the material should be controllable.

SUMMARY OF THE INVENTION

According to the present invention, a method of breaking a hard compact material, such as rock, comprises delivering hydraulic fluid into at least one hole which was pre-drilled by a drill in the material to be broken, the hole functioning as an hydraulic fluid cylinder. The fluid in the hole is impacted with a piston to generate a high pressure in the fluid and to cause tensile stress cracks in the material by the established pressure. The invention is characterized in that due to the concentration of the stress at the bottom of the hole, the cracks are initiated at the offsetting parts thereof spreading generally radially outwardly substantially normal to the principal stress direction. The propagating cracks may be linked to either adjacent cracks or faults or to free surfaces of the material to be broken by choosing the form, depth, orientation, spacing and number of said hole or holes so as to break the material into the desired fragments.

Apparatus to carry out the above method comprises a gun, such as a compressed air, combustion or hydraulical gun, driving a piston which is shaped in accordance with the form of the hole, into the hole at speeds ranging from about 50 m/sec. up to several hundred meters/sec.

BRIEF DESCRIPTION OF THE DRAWINGS

FIG. 9 shows a schematic view of a drill;

FIG. 10 shows a schematic sectional view of a gun with a piston and hydraulic fluid jet conduits and a fluid-filled hole in a vertical wall; and FIG. 11 shows a schematic sectional view of a plastic tube containing a piston and hydraulic fluid, and an empty hole in a vertical wall.

DETAILED DESCRIPTION

Figure 1:
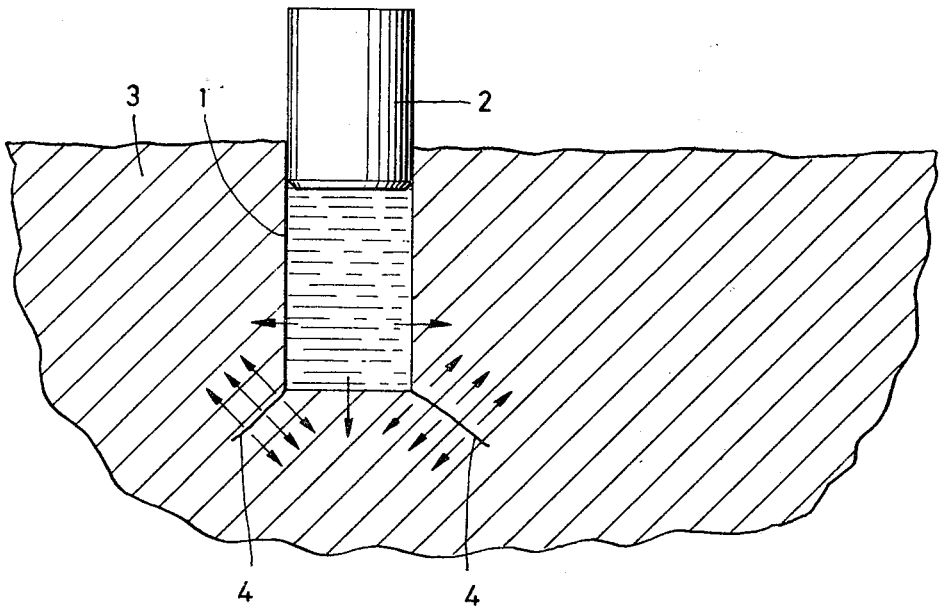
FIG. 1 shows a schematic sectional view of a cylindrical hole in a material to be broken with an initial crack growth.
Figure 2:
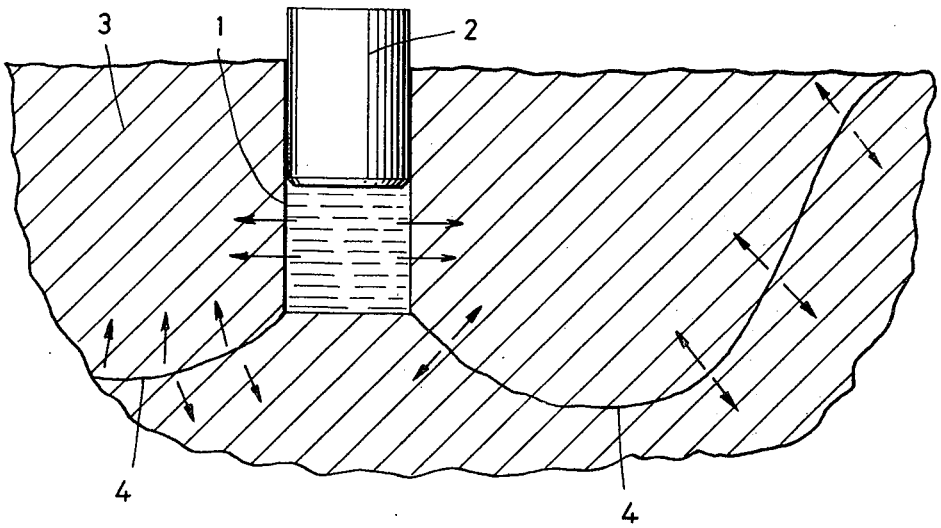
FIG. 2 shows a schematic sectional view of the hole of FIG. 1 with the final crack shape.

The basic hydraulic breaking technique is schematically illustrated in FIGS. 1 and 2. A cylindrical hole 1, several diameters in depth, is drilled in a rock 3 using either a percussive drill or a diamond core drill (not shown. The so made hole 1 is filled with water or some other liquid (e.g. grease, plasticine) which can be made to flow hydrodynamically at high pressures. The water or other liquid in the hole 1 is then impacted with a piston 2 which is driven by a not shown gun. The diameter of the piston 2 is the same or slightly smaller than that of the hole 1.

If the water in the hole 1 is impacted with the piston 2 at a velocity of at least 50 meters/sec. a shock wave giving a pressure of more than 750 bar is obtained. Such a shock wave is already sufficient to initiate radial cracks 4 in the rock, but is sufficiently low to avoid crushing of the walls. As the initial shock wave generated by the piston 2 reflects from the bottom of the bore hole 1, there is a further increase in pressure. Subsequent shock reflections between the piston 2 and the bottom of the hole 1 cause the pressure to rise still further. As soon as the necessary pressure is established at the bottom of the hole 1, tensile failure is initiated at the off-setting parts of the cylindrical hole 1 as shown in FIG. 1. The shape of the hole is very important, since by deliberately introducing stress concentrations in the bottom of the same, both the origin and the initial directions of the crack 4, i.e., normal to the principal stress direction, can be controlled.

Figure 3:
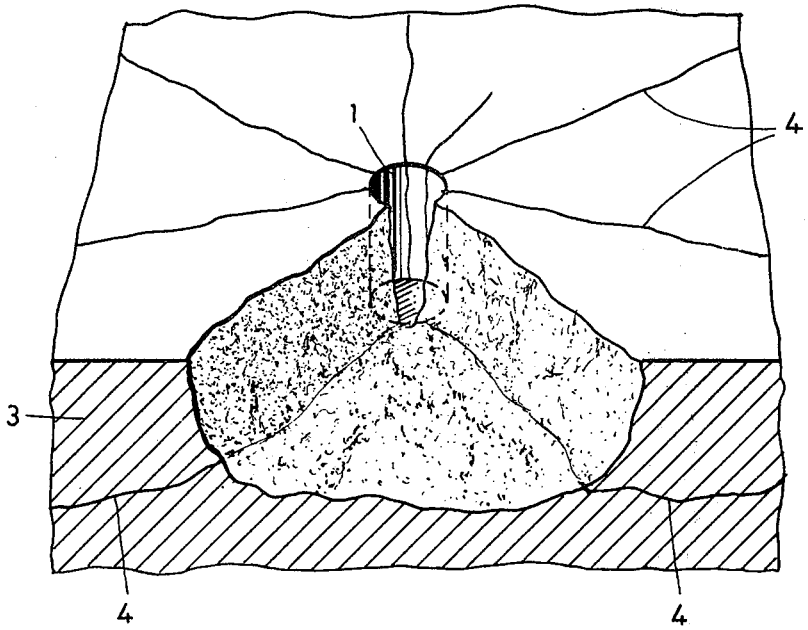
FIG. 3 shows a schematic top view of the final mushroom crack pattern for a cylindrical hole with a crater.

After the crack 4 has propagated a certain distance, the effects of the free surface are felt and the crack turns upwards towards the surface, driven by the combined effects of the rising pressure in the hole and the pressure of the liquid in the crack (FIG. 2). High speed photographs using transparent plexiglass targets have confirmed that the pressurized liquid indeed follows and flows in the crack. In this case a saucer or mushroom shaped crack is formed and a correspondingly shaped piece of rock 3 is removed, whereby radial cracks facilitate removal of the chips (see FIG. 3).

By a judicious choice of piston velocity and amount of energy, overbreak is avoided. Here, it is important to note that rocks are much weaker in tension than in compression, a fact which is exploited with the method of the present invention.

Figure 4:
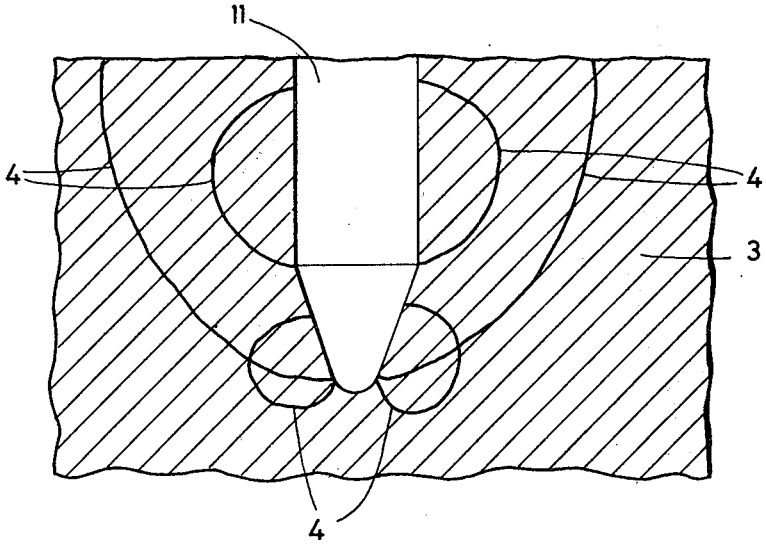
FIG. 4 shows a schematic sectional view of a hole with a conical bottom and a "Christmas tree" crack pattern for the same.

Other crack configurations can be produced by changing the geometry of the hole and, in particular, the shape of the bottom of the hole, which determines the initial direction of the crack. Accordingly, a hole 11 with a conical bottom could result in a "Christmas tree" like crack pattern (FIG. 4); even here the cracks initiate at the off-setting parts of the hole 11 spreading concentrically normally to the principal stress direction. Other forms of the hole are possible whereby the bottom of such holes is sharp-edged or rounded.

In an actual tunnelling or mining operation it is important that the energy used is a minimum. This, together with the size of the face or seam to be excavated and the size of the debris required, will determine the optimum breaking pattern.

Figure 5:
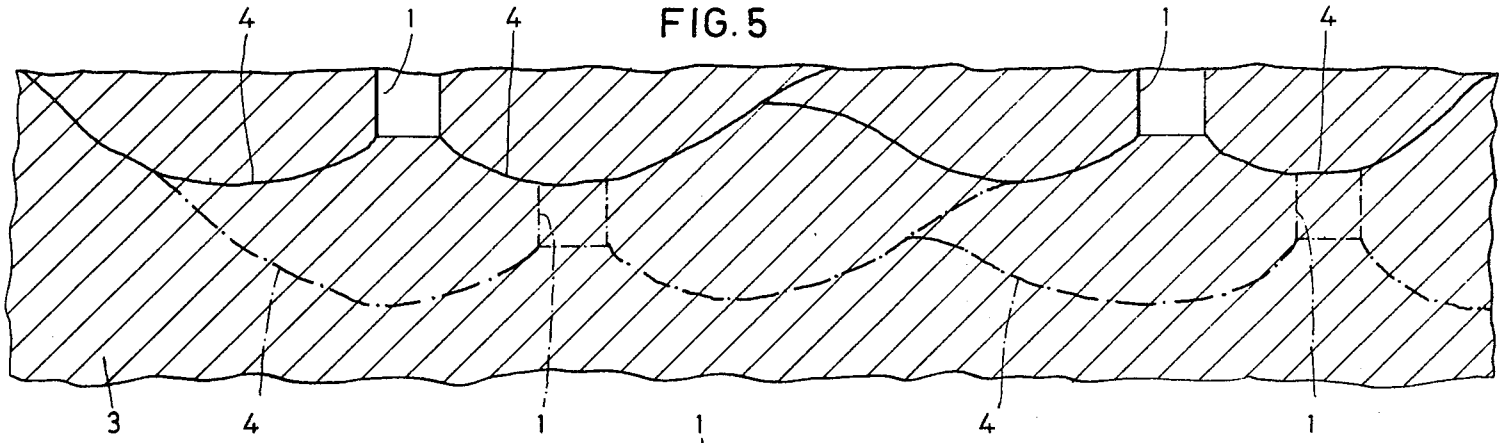
FIG. 5 illustrates an example of "shallow-plate" breaking with a sequence of rock removal.

Using cylindrical holes approximately one diameter deep and a suitable amount of energy, the characteristic saucer or mushroom shaped cracks will be produced which reach the free surface of the material where a crater is formed. In this way shallow plates or chips are produced (FIG. 5). If the holes 1 are made much deeper ($H/d \sim 5$, where H is the length and *d* the diameter of the hole) and the same piston energy is used as in the previous case, the crack will not reach the surface so easily but will remain more or less parallel to the free surface. By linking up several cracks (FIG. 7) a much deeper plate may be broken out. This "deep-plate" breaking is somewhat superior to the "shallow-plate" breaking described above from a specific energy point of view, since the first part of the crack requires less energy or lower pressures for its creation than the second part. On the other hand, near the periphery of the plate to be broken out, vertical cracks must be produced which reach the surface. These can be obtained by drilling and breaking obliquely, by the use of shallower holes near the periphery or holes of a different form (e.g. conical). It should be noted that some variations in the hole depth can be tolerated since the cracks have a natural tendency to link up.

Figure 6:
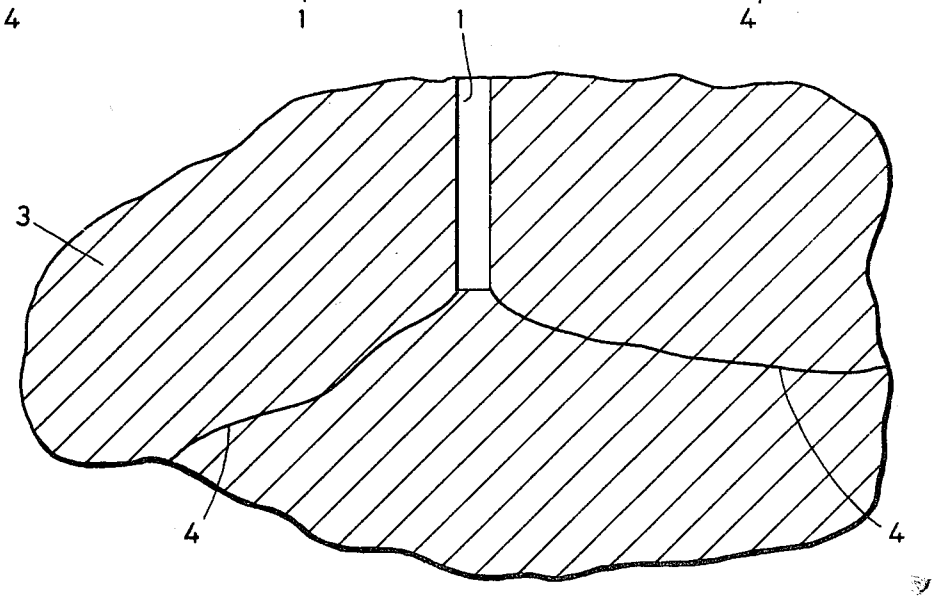
FIG. 6 illustrates a technique for splitting boulders, whereby the cracks seek the nearest free surface.
Figure 7:
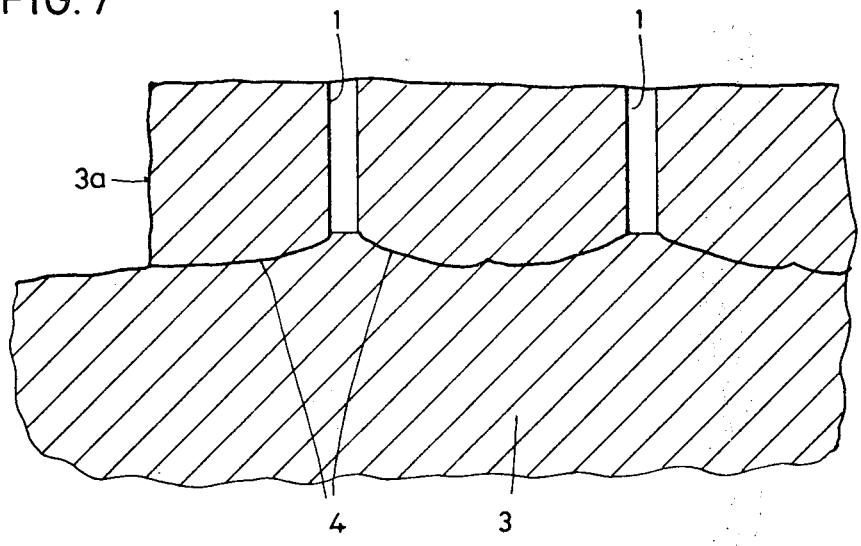
FIG. 7 illustrates an example of "deep-plate" breaking.
Figure 8:
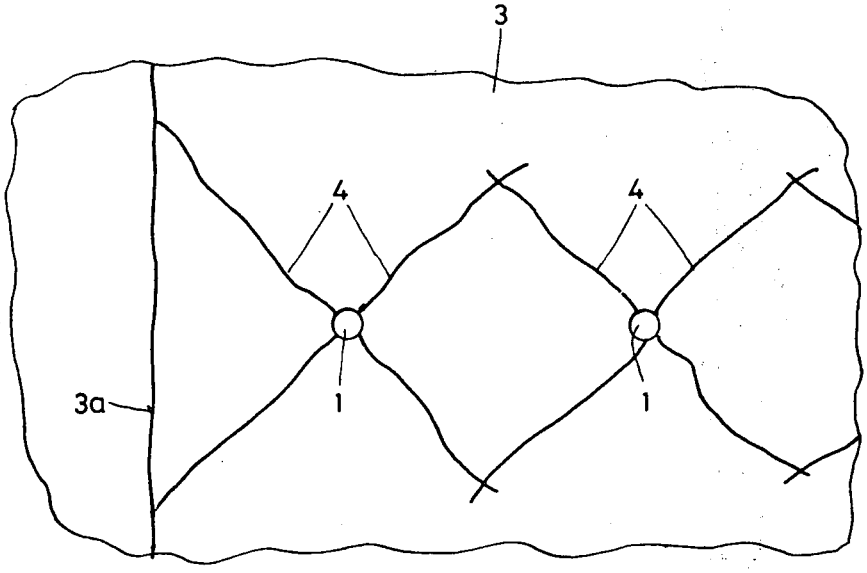
FIG. 8 shows a top view of the cracks according to FIG. 7.

For splitting a boulder, for bench breaking or for rock formations having natural faults in a direction normal to free surfaces of the material, deeper holes 1 may be used as illustrated in FIGS. 6 and 7. For rock formations having fault planes parallel to the free surface, a hole geometry (e.g. conical) or loading conditions producing primarily radial or vertical cracks should be used. In all these cases a deliberate use of the free surfaces 3*a* (FIG. 7) of the material to be broken out to which the propagating cracks 4 are linked helps to disengage the same.

The hydraulic breaking technique of the present invention presents few, if any, engineering problems. Compresed air, combustion or hydraulically operated guns capable of driving a piston at speeds up to several hundred meters/sec. are easily realizable. It is evident, that the piston driven by such a gun has to be shaped in conformity with the hole in which it is to be launched. Similarly, drilling the hole in the rock is a trivial problem. The critical problem is, however, to keep the working hydraulic fluid in the hole, particularly when working in a sloping wall or in a roof.

Embodiments of a gun for use in the present invention are shown in FIGS. 10–11 FIG. 9 represents a drill 5 having two concentric drill faces 6 and 7 enabling a crown 8 (FIG. 10) to be drilled simultaneously with the hole 1, the crown 8 being used for centering the gun with the axis of the hole 1.

The embodiment shown in FIG. 10 uses several water jet conduits 10 directed into the hole 1 in a vertical rock face 3. The conduits 10 are arranged in a centering head 17 around the cylinder 18 which contains a piston 2. A spring 16 is provided for biasing the centering head 17 and against the action of which the centering head 17 is slightly movable on the cylinder 18. This embodiments ensure that the hole 1 remains filled with the fluid even if the surrounding material 3 is fissured or highly absorbent.

FIG. 11 illustrates another embodiment which includes a piston 2*b* of hard material (e.g. metal, concrete, plastic) encapsulated in a preferably plastic tube 15 closed by a plug 20. The front part of the tube 15 is filled with water or another hydraulic fluid which can be separated from the piston 2*b* by a partition 19. The piston 2*b* is launched in the direction of the arrow from a not shown gun with the tube 15 containing the water into an empty hole 1 in the rock 3 where the tube 15 bursts under the impact pressure. The burst tube 15 acts as a sealing preventing the water from escaping out from the hole 1. This solution is a particular interest for deep hole operations, e.g. boulder splitting, as shown in FIG. 6, or bench blasting as shown in FIG. 7.

The method and apparatus described above brings the following advantages: Apart from soft materials such as coal, also hard compact materials, e.g. rock, plexiglass, concrete, metal ores, can be broken. By the careful control of energy input and the geometry of the hole, overbreak can be eliminated and the size of the fragments to be broken out can be controlled. This facilitates mechanized mucking operations. Owing to the controllable hole shape the method is suitable for selective mining.

As an example, we may cite the case where excavations have been made in Swedish red granite (compressive strength approximately 2 kbar). The holes were 30 cm deep and 35 mm in diameter. The piston was made of hardened tool steel weighing 1 kg which was launched from a compressed air cannon at a velocity of approximately 150 m/sec. To initiate the excavation a V-cut was made using two parallel rows of holes inclined at 45° to the rock face. This allowed the V shaped section of rock between the holes to be removed. Subsequent rows of holes were drilled normal to the rock face allowing the rock to be broken out towards the free surfaces thus created. The hole spacing was approximately 30 cm. The next layer of rock was removed by repeating this process.

We claim:

1. A method of breaking a hard compact material, especially rock, having at least one hole pre-drilled in the material area to be broken, comprising:

filling said hole with a liquid by continuously injecting the liquid in said hole; and impacting said liquid inside said hole with a piston driven therein for hydraulically pressurizing said liquid in said hole and initiating tensile stress cracks to form in said material area for generating a shock wave which is subsequently reflected from the bottom of said hole and the face of the piston to cause a rise of pressure in said hole.

2. The method according to claim 1 comprising maintaining said pressure on said liquid inside said hole after said impacting for a short period of time to cause said pressurized liquid to flow in the formed cracks.

3. The method according to claim 1, wherein the bottom of said hole is sharp-edged.

4. The method according to claim 1, wherein the bottom of said hole is rounded.

5. The method according to claim 1 comprising drilling a plurality of spaced holes in said material to be broken to form propagating cracks which are linked towards the free surfaces of the material to be broken out when said liquid is pressurized in said holes by said impacting.

6. The method according to claim 1 comprising driving said piston at speeds ranging from about 50 m/sec up to several hundred meters per second into said hole to pressurize said liquid.

7. The method according to claim 1, wherein said hole has a cylindrical shape, said cracks spreading from said cylindrically-shaped hole to form a generally mushroom-shaped pattern.

8. The method according to claim 7 comprising drilling a plurality of spaced holes approximately one diameter deep in said material to be broken for linking said cracks of generally mushroom-shaped pattern to form shallow plates.

9. The method according to claim 7 comprising a plurality of spaced holes several diameters deep in said material to be broken for linking said cracks of generally mushroom-shaped pattern to form deep shallow plates.

10. The method according to claim 7, wherein the bottom of said hole is sharp-edged.

11. The method according to claim 1, wherein said hole has a generally conical bottom, said cracks spreading from said hole to form a generally "Christmas tree" pattern.

12. The method according to claim 11 wherein said hole has a generally cylindrical shape above said generally conical bottom.

13. Apparatus for breaking a hard compact material, such as rock, having a hole formed in an area of the material to be broken, comprising:

a piston having an outer peripheral shape corresponding to the peripheral shape of the hole formed in said material area to be broken;

means for filling said hole with a liquid, said filling means including means for continuously injecting the liquid into said hole to maintain said hole filled with said liquid; and means for driving said piston into said hole at speeds of at least 50 m/sec and ranging up to several hundred meters per second to impact said liquid inside said hole for pressurizing said liquid and causing cracks to form in said material area to be broken.

14. Apparatus according to claim 13 wherein said means for driving said piston comprises a compressed air gun.

15. Apparatus according to claim 13 wherein said means for driving said piston comprises an hydraulically operated gun.

16. Apparatus according to claim 13 wherein said means for driving said piston comprises a combustion driven gun.

17. Apparatus according to claim 13 wherein said driving means for said piston includes means for maintaining said pressure on said liquid inside said hole for a short period of time after said impacting.

18. Apparatus according to claim 13, wherein said means for supplying liquid to said hole comprises hydraulic fluid jet conduits directed into said hole for continuously and supplying said liquid to said hole.

19. Apparatus according to claim 18, comprising a cylinder arranged around said piston, said cylinder opening in the vicinity of the opening of said hole, said fluid jet conduits being arranged around said cylinder.

20. Apparatus according to claim 19 wherein said fluid jet conduits extend within a shroud which is adapted to abut the surface of the material to be broken, said shroud being slidably mounted to said cylinder, and including biasing means carried by said cylinder for biasing said shroud and said fluid jet conduits toward the free surface of the material to be broken.

21. A method of breaking a hard compact material, especially rock, having at least one hole pre-drilled in the material area to be broken, comprising:

filling said hole with a liquid by introducing in said hole a rupturable capsule containing at least the liquid; and impacting said liquid inside said hole with a piston driven therein for rupturing said capsule, hydraulically pressurizing said liquid in said hole and initiating the formation of tensile stress cracks in said material area for generating a shock wave which is subsequently reflected from the bottom of said hole and the face of the piston to cause a rise of pressure in said hole.

22. The method according to claim 21 comprising sealing said piston within said hole during said impacting by means of said rupturable capsule which surrounds said piston.

23. The method according to claim 21 wherein said rupturable capsule is made of a plastic material.

24. A method according to claim 21, comprising sealing said piston in said capsule, said capsule being introduced into said hole with said piston outermost relative to the opening of said hole to cause said capsule to rupture upon driving of said piston.

25. The method according to claim 21 comprising maintaining said pressure on said liquid inside said hole after said impacting for a short period of time to cause said pressurized liquid to flow in the formed cracks.

26. The method according to claim 21, wherein the bottom of said hole is sharp-edged.

27. The method according to claim 21, wherein the bottom of said hole is rounded.

28. The method according to claim 21 comprising drilling a plurality of spaced holes in said material to be broken to form propagating cracks which are linked towards the free surfaces of the material to be broken out when said liquid is pressurized in said holes by said impacting.

29. The method according to claim 21, wherein said hole has a cylindrical shape, said cracks spreading from said cylindrically-shaped hole to form a generally mushroom-shaped pattern.

30. The method according to claim 29 comprising drilling a plurality of spaced holes approximately one diameter deep in said material to be broken for linking said cracks of generally mushroom-shaped pattern to form shallow plates.

31. The method according to claim 29 comprising a plurality of spaced holes several diameters deep in said material to be broken for linking said cracks of generally mushroom-shaped pattern to form deep shallow plates.

32. The method according to claim 29, wherein the bottom of said hole is sharp-edged.

33. The method according to claim 21, wherein said hole has a generally conical bottom, said cracks spreading from said hole to form a generally "Christmas tree" pattern.

34. The method according to claim 33, wherein said hole has a generally cylindrical shape above said generally conical bottom.

35. Apparatus for breaking a hard compact material, such as rock, having a hole formed in an area of the material to be broken, comprising:

means for filling said hole with an hydraulic fluid, said filling means including a rupturable tubular member containing said hydraulic fluid therein;

a piston having an outer peripheral shape substantially corresponding to the peripheral shape of the hole formed in said material area to be broken, said piston being mounted within said rupturable tubular member;

means for sealing said piston and hydraulic fluid within said tubular member; and means for driving said tubular member and piston into said hole with said piston being driven at speeds ranging up to several hundred meters per second to impact said hydraulic fluid inside said hole for rupturing said tubular member to free said hydraulic fluid and for pressurizing said hydraulic fluid to cause cracks to form in said material area to be broken.

36. Apparatus according to claim 35 wherein said sealing means comprises an end sealing member sealingly engaged with said tubular member.

37. Apparatus according to claim 35 comprising a partition member within said tubular member and interposed between said hydraulic fluid and said piston.

38. Apparatus according to claim 35 wherein said tubular member is comprised of plastic material which is adapted to provide a seal between said piston and the walls of said hole so as to minimize leakage of said hydraulic fluid out of said hole when said tubular member is ruptured.

39. Apparatus according to claim 35 wherein said driving means comprises an hydraulically operated gun.

40. Apparatus according to claim 35 wherein said driving means comprises a combustion driven gun.

* * * * *

UNITED STATES PATENT OFFICE

CERTIFICATE OF CORRECTION

PATENT NO. : 3,988,037

DATED : October 26, 1976

INVENTOR(S) : Jean-Paul DENISART et al

It is certified that error appears in the above-identified patent and that said Letters Patent are hereby corrected as shown below:

Column 6, line 17, after "continuously" delete "and".

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*